US006087997A

United States Patent [19]

Cipolla

[11] Patent Number: 6,087,997

[45] Date of Patent: Jul. 11, 2000

[54] APPARATUS AND METHOD FOR ENABLING THE PASSAGE OF SIGNALS THROUGH AN ANTENNA DISH

[75] Inventor: Frank W. Cipolla, Newbury Park, Calif.

[73] Assignee: Datron/Transco, Inc., Simi Valley, Calif.

[21] Appl. No.: 09/189,773

[22] Filed: Nov. 10, 1998

Related U.S. Application Data

[60] Provisional application No. 60/065,058, Nov. 10, 1997.

[51] Int. Cl.[7] ..... H01Q 15/02; H01Q 21/00

[52] U.S. Cl. ..... 343/725; 343/705; 343/909

[58] Field of Search ..... 343/725, 727, 343/729, 705, 708, 909, 753; H01Q 15/02, 21/00

[56] References Cited

U.S. PATENT DOCUMENTS 5,373,302 12/1994 Wu ..... 343/909

5,892,485 4/1999 Glabe et al. ..... 343/909

*Primary Examiner*—Hoanganh Le

*Attorney, Agent, or Firm*—Edward A. Sokolski

[57] ABSTRACT

An antenna dish for reflecting signals for a first antenna operating in a first frequency band is mounted in proximity to a second antenna operating in a second frequency band separated from the first band. With the two antennas in certain relative orientations, the dish is partially or totally in the receiving and transmitting path of the second antenna. The dish is modified so that signals in the first frequency band can effectively pass through the dish. This end result is achieved by placing conductive antenna elements over the entire reflecting surface, these elements being dimensioned to efficiently radiate and receive signals in the first frequency band, thereby permitting such signals to effectively pass through the reflector dish.

9 Claims, 2 Drawing Sheets

APPARATUS AND METHOD FOR ENABLING THE PASSAGE OF SIGNALS THROUGH AN ANTENNA DISH this application claims benefit to U.S. provisional application Serial No. 60/065058 filed Nov. 10, 1997.

BACKGROUND OF THE INVENTION

1. Field of the Invention

This invention relates to radio antennas and more particularly to a reflector dish for such an antenna through which signals in a predetermined frequency band can pass.

2. Description of the Related Art

Two antennas transmitting signals in different frequency bands are often mounted in close proximity to each other such as on the fuselage of an aircraft. Where one of such antennas employs a dish, this dish can block the transmission and reception of signals by the other antenna when the transmission and reception paths for the two antennas has the same or a closely similar orientation. To the best knowledge of the inventor, there are no effective prior art devices for overcoming this problem.

SUMMARY OF THE INVENTION

The device of the present invention solves this problem by placing a plurality of antenna units on or close to the reflective surface of the dish, such units covering substantially the entire surface of such dish. These antenna units are metallic and are dimensioned to efficiently receive and transmit signals in the frequency band of the antenna the signals of which would otherwise be blocked. These antenna units may comprise half wave dipoles or tripoles at the wavelength of interest.

The antenna units may be formed by etching the plurality of such units on a Mylar sheet, employing the same technique as used in fabricating printed circuits. The Mylar sheet is then attached to the front concave portion of the disk and covered with a thin layer of epoxy by conventional plastic molding techniques. It is to be noted that while a similar frequency selective surface technology has been used in the past to build dichroic subreflectors for Cassegrainian antenna systems and to make frequency selective radomes for military aircraft, "transparent" antennas of the present invention which permit signals from other antennas to pass through, have not to applicant's knowledge been used in the past.

It is therefore an object of this invention to enable two antennas operating in different frequency bands, at least one of which includes a dish to operate effectively in close proximity to each other.

It is a further object of this invention to provide an antenna dish which is effectively transparent in a particular frequency band at which a proximate antenna operates and a method for providing such operation.

Other objects of the invention will become apparent from the following description taken in connection with the accompanying drawings.

DETAILED DESCRIPTION OF THE INVENTION

Figure 1:
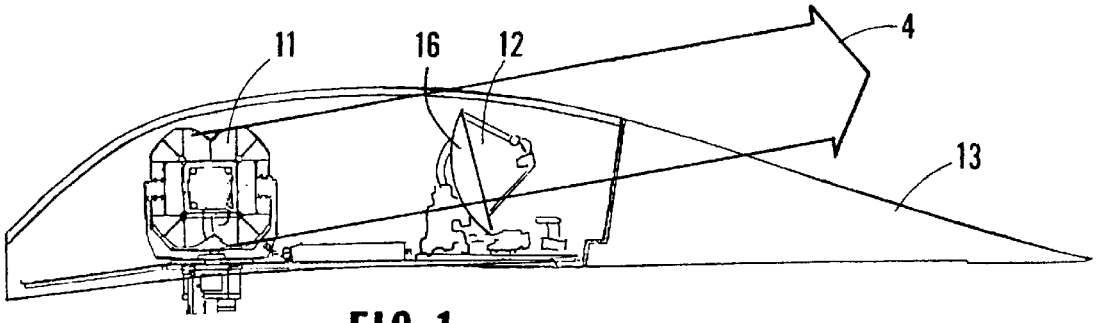
FIG. 1 is a diagrammatic drawing illustrating the problem which the device of the invention solves.
Figure 2:
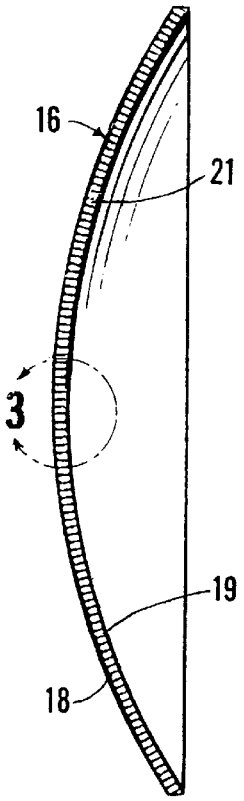
FIG. 2 is an elevational view in cross section illustrating the dish employed in the device of the invention.
Figure 3:
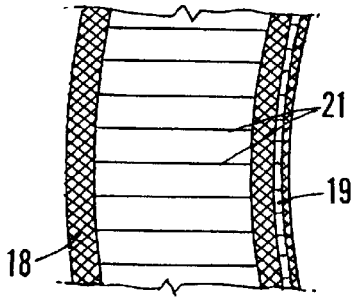
FIG. 3 is an enlarged cutaway view illustrating the structure of the dish employed in the device of the invention.

Referring now to FIG. 1, the basic operation of the invention is illustrated. Antennas 11 and 12 are mounted on the body of aircraft 13 in proximity to each other. Antenna 11 may be used for satellite telephone communication operating in the 1.53–1.66 GHz band while antenna 12 may be a dish antenna used for receiving TV signals from a satellite, operating in the 11.2–12.7 band. The dish antenna typically is a parabolic reflector having a diameter of about 11.5 inches. When the beam from and to antenna 11 is in the direction indicated by arrow 4 and the satellite dish 16 of antenna 12 is also oriented in this direction, the beam will be blocked by the dish of antenna 12 unless means are taken to make the dish effectively "transparent" at the frequency of the signals transmitted from and transmitted to antenna 11. The present invention, as now to be described effectively makes for such transparency.

Referring now to FIGS. 2–5, a preferred embodiment of the invention is illustrated. Antenna dish 16 is formed from inner and outer layers 18 and 19 which may be of glass epoxy. Sandwiched between these two layers is a honeycomb structure 21 such as Nomex honeycomb.

Figure 4:
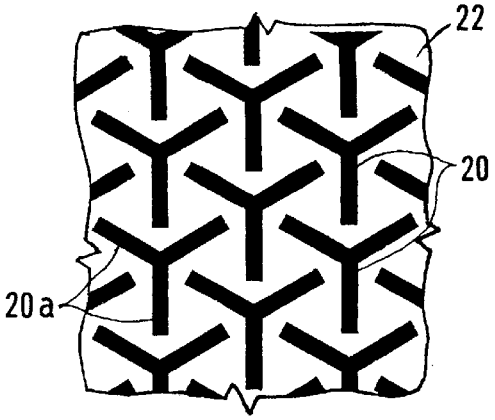
FIG. 4 is a top plan view illustrating a portion of the sheet on which the tripoles utilized in the device of the invention are formed.
Figure 5:
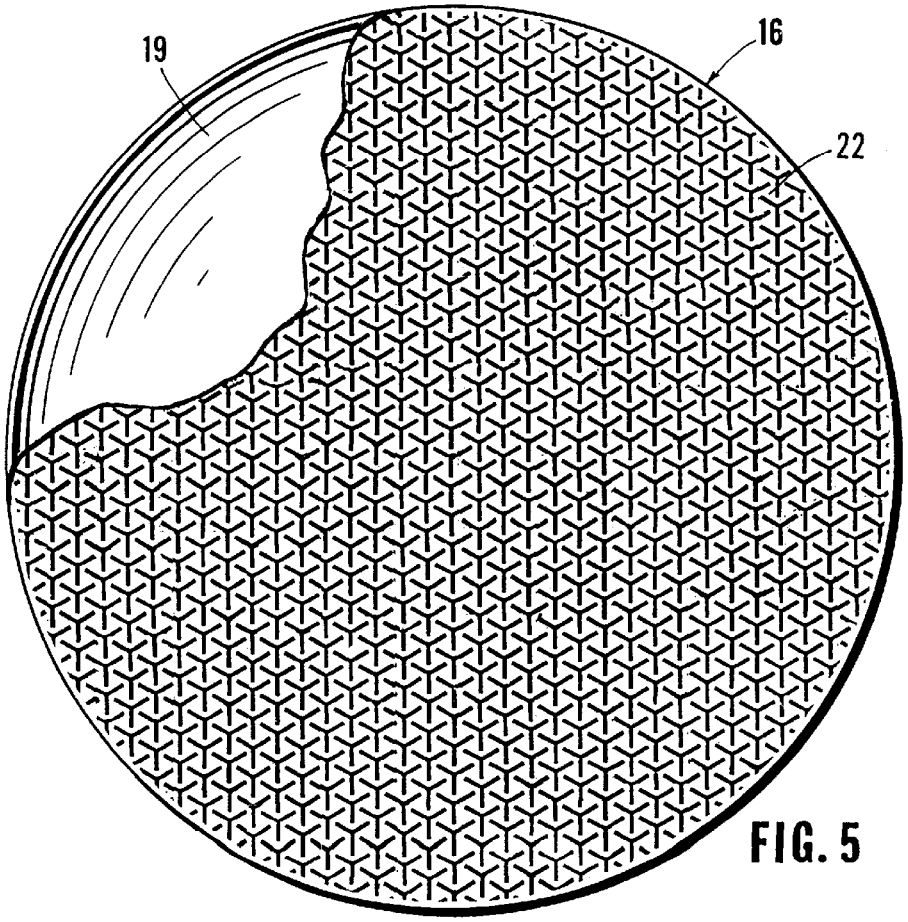
FIG. 5 is a front elevational cutaway view illustrating a preferred embodiment of the dish of the invention.

As shown in FIG. 4 plurality of metallic tripole units 20 are etched onto the surface of a thin sheet 22 of a material such as Mylar having a thin metallic coating. This can be done in the same manner as printed circuit boards are fabricated. Each of the legs 20*a* of the "Y" is dimensioned to be a quarter wavelength in length at the frequency of the signals to be passed through the dish. Two quarter wavelength sections form a half wavelength dipole antenna which resonates by antenna 11 and thus effectively makes the dish transparent at this frequency.

The Mylar sheet 22 is embedded between plies of the glass epoxy layers 19 and thus retained as an integral portion of the dish.

It is to be noted that the antenna units 20 can be in other configurations, e.g. dipoles, other multiples of a quarter wavelength, etc. as long as they transmit and receive efficiently at the frequency of the signals to be passed through the dish.

In one embodiment of the invention, parabolic reflector has a diameter of 11.5 inches with antenna 11 operating in the L-band (1.53–1.66 GHz) and antenna 12 operating in the Ku band (11.2–12.7 GHz). The quarter wave sections 20 in this embodiment are 0.185 inches.

While the invention has been described and illustrated in detail it is to be understand that this is intended by way of illustration and example only, the scope of the invention being limited by the terms of the following claims.

I claim:

1. In combination, a pair of separate antennas mounted in proximity to each other, said antennas comprising:

a first antenna operating in a first frequency band, a second antenna operating in a second frequency band, said second antenna having a concave reflector dish, a plurality of antenna units formed on the concave side of said dish and extending over substantially said entire concave side, said antenna units being formed of a plurality of quarter wave elements at the frequency of said first frequency band, and thus being dimensioned to efficiently transmit and receive signals in said first frequency band, whereby when the reflector dish of said second antenna is in the transmission and reception path of said first antenna, said antenna units operate to radiate signals to and from said first antenna.

2. The combination of claim 1 wherein said antenna units are etched onto a sheet which is attached to said disk.

3. The combination of claim 1 wherein said antennas are mounted on the body of an aircraft.

4. The combination of claim 1 wherein said antenna units are dimensioned to form tripoles at the frequencies of the first frequency band.

5. The combination of claim 1 wherein said reflector dish is a parabolic reflector.

6. A method for enabling the efficient transmission of radio signals to and from a first antenna through the reflector dish of a second antenna, said second antenna having an operating frequency substantially different from that of said first antenna and being separate from and spaced from said first antenna, comprising the steps of:

forming a plurality of metallic antenna units comprising a plurality of elements, each having a length which is equal to a quarter wavelength at the operating frequency of said first antenna over substantially the entire surface of a sheet, said antenna units being dimensioned to efficiently transmit and receive radio signals at the operating frequency of said first antenna, and attaching said sheet to the reflector dish of said second antenna to substantially extend over the entire surface area of said dish, whereby said first antenna is capable of transmitting and receiving signals through the dish of said second antenna at its operating frequency.

7. The method of claim 6 wherein said first and second antennas are mounted on the body of an aircraft.

8. The method of claim 6 wherein said antenna units are dimensioned to form tripoles at the operating frequency of said first antenna.

9. The method of claim 6 wherein said sheet has a metallic coating and said antenna units are formed by etching them on said coating.

* * * * *